US007686539B2

(12) United States Patent
Aristaghes et al.

(10) Patent No.: US 7,686,539 B2
(45) Date of Patent: Mar. 30, 2010

(54) WATER MOVEMENT DAMPER DEVICE

(75) Inventors: Pierre Aristaghes, Voisins le Bretonneux (FR); Raphaelle Pouezevara, Paris (FR)

(73) Assignee: Saipem S.A., Montigny le Bretonneux (FR)

( * ) Notice: Subject to any disclaimer, the term of this patent is extended or adjusted under 35 U.S.C. 154(b) by 200 days.

(21) Appl. No.: 11/920,614

(22) PCT Filed: May 18, 2006

(86) PCT No.: PCT/FR2006/001115

§ 371 (c)(1),
(2), (4) Date: Nov. 16, 2007

(87) PCT Pub. No.: WO2006/123053

PCT Pub. Date: Nov. 23, 2006

(65) Prior Publication Data

US 2009/0238645 A1 Sep. 24, 2009

(30) Foreign Application Priority Data

May 20, 2005 (FR) ..... 05 05113

(51) Int. Cl.
*E02B 3/06* (2006.01)

(52) U.S. Cl. ..... 405/28; 405/30; 405/31; 405/35; 405/27

(58) Field of Classification Search ..... 405/21, 405/24, 26, 27, 28, 30, 31, 33, 34, 35
See application file for complete search history.

(56) References Cited

U.S. PATENT DOCUMENTS 214,299 A * 4/1879 Johnson ..... 405/28
214,953 A 4/1879 Johnson
3,353,361 A 11/1967 Lloyd
3,953,977 A * 5/1976 Kikui et al. ..... 405/27
5,429,452 A * 7/1995 Frost ..... 405/26

(Continued)

FOREIGN PATENT DOCUMENTS

FR 1267953 7/1961

(Continued)

*Primary Examiner*—Frederick L Lagman
(74) *Attorney, Agent, or Firm*—Cohen Pontani Lieberman & Pavane LLP

(57) ABSTRACT

The present invention relates to a water movement device comprising a flexible wall (1) placed in water close to the surface, substantially vertically in a static rest state, made up of optionally perforated (5) massive unit blocks (4) assembled to one another in strings by cables (2, 3) on which said blocks (1) are threaded or on which said blocks are crimped, said cables comprising: a series of cables (2) disposed vertically (ZZ') side by side, parallel to one another, and a second series of cables (3) disposed horizontally (XX') one above another and in parallel, and said vertical cables (2) being suspended or tensioned at their top ends and/or respectively tensioned or moored at their bottom ends, and said blocks including empty orifices (5) passing through them between the front and rear faces (1-1, 1-2) of said wall (1), and/or empty spaces (7) between said blocks, such that said orifices (5) and/or empty spaces between said blocks (7), if any, confer overall porosity on said wall lying in the range 5% to 75%, preferably 20% to 45%, of the area of the vertical section of said wall.

24 Claims, 5 Drawing Sheets

U.S. PATENT DOCUMENTS

| | | | | | |
|---|---|---|---|---|---|
| 5,820,295 | A * | 10/1998 | Buteaux | ..... | 405/21 |
| 5,879,105 | A * | 3/1999 | Bishop et al. | ..... | 405/26 |
| 5,975,796 | A * | 11/1999 | Angel et al. | ..... | 405/28 |
| 6,669,403 | B2 * | 12/2003 | Clark et al. | ..... | 405/30 |
| 7,524,139 | B2 * | 4/2009 | Bishop | ..... | 405/21 |
| 7,524,140 | B2 * | 4/2009 | Bishop | ..... | 405/30 |
| 2009/0022548 | A1 * | 1/2009 | Bishop | ..... | 405/33 |

FOREIGN PATENT DOCUMENTS

| | | |
|---|---|---|
| GB | 1444835 | 8/1976 |

* cited by examiner

WATER MOVEMENT DAMPER DEVICE

PRIORITY CLAIM

This is a U.S. national stage of application No. PCT/FR2006/001115, filed on May 18, 2006. Priority is claimed on the following application(s): Country: France, Application No.: 05/05113, Filed: May 20, 2005, the content of which is incorporated here by reference.

BACKGROUND OF THE INVENTION

1. Field of the Invention

The present invention relates to a device constituting a wall, partition, or curtain for damping water movement(s) and intended more particularly for damping the slipstreams induced by the propellers of ships, and also chop and swell of small amplitude. It is intended more particularly to be installed vertically within pontoons on piles, more precisely under said pontoons and between the supporting piles in port installations.

2. Discussion of Related Art

A port is a space in which ships maneuver, with the help of their thrusters (propellers and/or bow thrusters in particular), in particular for docking or for leaving the quayside where they were moored. Such thrusters deliver slipstreams that can propagate over long distances and that can give rise to scouring that is limited or eliminated by anti-scouring devices that are generally placed at the bottoms of structures or in sensitive zones. Such thruster slipstreams can also lead to discomfort or difficulties in docking for certain boats situated nearby.

The movement of ships also gives rise to waves of short period, thus also interfering with boats, in particular yachting or fishing boats, in the same manner as chop generated by local winds.

In port environments, it is generally desirable to create protected zones in which the surface of the water remains calm, and numerous techniques have already been developed for creating such sheltered zones, and mention can be made of uninterrupted breakwaters, interrupted breakwaters, Jarlan type rigid perforated walls, and caisson walls. With all those techniques, the idea is either to reflect a wave, causing it merely to head back out to sea, or else to dissipate the intrinsic energy in the mass of moving water, either by transforming it directly into heat within the mass of water (uninterrupted or partial breakwaters), or by recovering the energy so as to transform it into electricity (tidal amplitude chambers), or indeed by creating phase shifts within the waves as occurs with caisson walls.

All of those systems present great effectiveness in absorbing strong swell and more particularly short swell. However, they are in general works of considerable mass since they need to withstand very large forces and to do so over durations exceeding 30 years to 50 years or even more.

The solution that consists in "waterproofing" quays of the type that are built on piles is not always desirable (even ignoring the extra cost), since that leads to unwanted reflections having the effect of increasing roughness, in particular at the end of a dock or along a straight quay, thereby reducing the comfort and the workability of berths along the quay.

With the exception of uninterrupted breakwaters that create a total screen, interrupted breakwaters, and caisson walls are not very effective in damping waves of long wavelength and chop generated by turbulent currents around the piles or created by ships' propellers while the ships are approaching their mooring points on a pontoon.

Patent WO 02/26019 describes a device that seeks to dissipate wave energy, the device comprising an array of floating modules of plastics material assembled together by a system of flexible rubber hinges, both in the vertical direction and in the horizontal direction, forming a system that is relatively complex and expensive to make, and also relatively fragile.

The complexity of the device described in WO 02/26019 comes from the particular shape of the modules defining particular openings, and from the shape of the assembly elements outside said modules.

In addition, the flexibility of the hinge system of WO 02/26019 constituted by resilient rubber assembly elements external to the various floating modules gives that device as a whole excessive mobility, leading to phenomena of wear and limited lifetime.

OBJECTS AND SUMMARY OF THE INVENTION

Thus, the problem posed is to provide a device that is capable of reducing the streams generated by ships' propellers operating close to or within a zone that is it is desired to protect as much as possible by maintaining an almost flat calm therein, and also to reduce low level swell and chop.

Another object is to provide a device that is less expensive and easier to make and install than the works in prior solutions.

Another object of the present invention is to provide a device presenting sufficient strength to withstand large forces and heavy loading, while being movable so as to allow localized deformation of the device in the event of strong swell or chop, but with ability to move being limited in such a manner as to reduce the phenomena of fatigue and wear and to increase the lifetime of the device.

To do this, the present invention provides a device for damping water movement such as the streams induced by ships' propellers, and also swell and chop, the device comprising a flexible wall placed in water close to the surface, substantially vertically in a static rest state, made up of optionally perforated massive unit blocks assembled to one another in strings by cables on which said blocks are threaded or on which said blocks are crimped, said cables comprising:

- a first series of cables disposed vertically (ZZ') and side by side, parallel to one another; and
- a second series of cables disposed horizontally (XX') one above another and in parallel; and each block is pierced through in the vertical direction and in the horizontal direction, so as to enable at least one said vertical cable and at least one said horizontal cable to pass therethrough, and each said block is assembled to at least one vertical cable, thereby forming a plurality of parallel vertical cable strings, and at least some of said blocks, and preferably each of said blocks, being assembled to at least one horizontal cable, thereby assembling the various vertical cable strings to one another, and said vertical cables being suspended or tensioned at their top ends and/or respectively tensioned or moored at their bottom ends; and the blocks are assembled in strings and the top faces of lower blocks come against the bottom faces of higher blocks along said vertical cables; and said blocks are spaced apart from one another along said horizontal cables by pads preferably of elastomer material, and preferably a bushing is crimped onto each end of each horizontal cable so that said pads are compressed to a substantially uniform prestress value; and said blocks include:

empty orifices passing through them between the front and rear faces of said wall; and/or empty spaces between said blocks;

whereby said orifices and/or empty spaces between said blocks confer overall porosity to said wall, preferably representing 5% to 75%, more preferably 20% to 45%, of the area of the vertical section of said wall.

The term "overall porosity" is used herein to designate the percentage of area that is empty relative to the total area of the vertical section of said wall. It will be understood that said wall is defined by:

the top and bottom faces of the end blocks respectively at the tops and the bottoms of said vertical cables; and the outside faces of the blocks situated at the two ends of said horizontal cables.

The device of the invention forms a wall that is also referred to as a "curtain", presenting a certain amount of flexibility, thus enabling it to deform when there is current, swell, or chop, and enabling large head losses to be created in the mass of water passing through the pores therein, thereby damping water movements, while providing great strength without risk of rupture due to its flexibility. Depending on its characteristics (mass per unit area, porosity, mooring technique), it can also oppose the transmission of waves up to a certain period (typically waves generated by passing ships or chop), which corresponds to a transmission coefficient that is substantially less than 1, i.e. the current, chop, or swell values are attenuated correspondingly.

Beyond that period (of value that depends on the mass and the flexibility of the curtain, on its porosity, on the way it is secured, . . . ), the transmission coefficient increases with the curtain tending to oscillate together with the waves, thus presenting two advantages: there is a ceiling put on levels of force (with a corresponding impact on the dimensioning of anchor points, particularly in terms of fatigue); and a limit put on the extent to which water is made rougher, due to the low reflecting power of the system.

The positioning of the various blocks resting on one another by gravity, being threaded on a common vertical cable, with the top faces of lower blocks against the bottom faces of higher blocks, ensures a certain amount of self-locking between said top and bottom faces respectively of two adjacent blocks relative to each other on a given vertical cable.

Advantageously, said blocks have top and bottom faces of complementary shape. This embodiment serves to increase the self-locking of said top and bottom faces respectively of two adjacent blocks on a vertical cable.

The tensioning of said vertical and horizontal cables and the self-locking of adjacent blocks on a vertical cable have the effects of stabilizing the shape of said wall by giving it a certain amount of stiffness and of maintaining the wall in a position that is substantially vertical, i.e. of avoiding excessive deformation in the event of the wall deforming as a result of water movements such as current, swell, or chop. The blocks bearing against one another generate prestress for the assembly which holds said string in a substantially straight vertical line (ZZ'), thereby opposing deformation to said string in the (YZ) plane.

The prestress in the horizontal cables also stabilizes the shape of the device by keeping each of said horizontal strings in a substantially straight horizontal line, thus opposing deformations of said strings in the (XY) plane, thus imparting a certain amount of stiffness to the curtain of strings, and thus holding it in preferred manner in the (XZ) plane. Overall, the stiffness of the device makes it possible practically to eliminate small amplitude movements that are not required for damping swell or chop, thereby saving on pointless wear and fatigue in said cables.

Nevertheless, said elastomer pads provide sufficient flexibility to the device of the invention to make localized deformations possible in the event of large forces due to swell or chop.

Thus, for small values of water particle speeds generated either by propeller slipstreams or by swell or chop, the device of the invention remains substantially plane and vertical while also attenuating said particle speeds. It is only when particle speeds increase significantly, that the device of the invention is observed to move. These high speeds, e.g. due to strong swell, lead to the device of the invention oscillating together with the waves. This serves to limit the forces that need to be withstood by the structures carrying the device of the invention, such as the piles of pontoons, thereby putting a limit on requirements in terms of strength and fatigue resistance for the piles and for the anchoring, and increasing the lifetime of the device of the invention.

Preferably, the vertical cables are suspended and tensioned by the weight of all of said blocks resting on one another under gravity, with the bottom end blocks being held on the cable in such a manner as to retain all of said blocks on the same vertical cable. It will be understood that blocks of the invention are not floating blocks and are thus much heavier than water, and more particularly they can advantageously be made of concrete, of plastics material, or of composite material.

More particularly, at least some of said blocks present said orifices, and more particularly still, each block has at least one said orifice.

Preferably, each block has a plurality of said orifices, and more preferably, said blocks present said orifices in a variety of shapes, for example cylindrical or frustoconical in shape, preferably of circular section, or a shape that is of the prismatic type, i.e. having a cross-section that is polygonal, square, or rectangular, or indeed a skew surface of the single sheet hyperboloid type, such as a Venturi.

In a preferred embodiment, said orifices present porosity representing at least 50% of said overall porosity of said wall.

The term "porosity of the blocks" is used to mean the empty percentage thereof, i.e. the percentage of empty area created by said orifices relative to the total area of a said block in vertical section.

According to another particular characteristic, said blocks present an axis in the direction that is perpendicular (YY') to said front and rear faces of said wall, but said axis could also be inclined.

The vertical and horizontal cables of the invention can be made of steel, preferably stainless steel, or of a strong composite or plastics material.

In various embodiments that are adapted to particular operating conditions explained below:

said perforated blocks present identical porosities; or said blocks in a given vertical cable string present porosities that decrease going downwards, and then the bottom end block is preferably a block without perforations, being made of concrete that is heavier than that used for the other blocks; or else said blocks in a given vertical cable string present greater porosities near the top and the bottom than in an intermediate portion.

Thus, in one embodiment, said wall is constituted by assembly of said vertical strings presenting porosities that vary in different ways, such that on going along a said horizontal cable string, variations in block porosity can be observed between different portions of said horizontal string.

In a preferred embodiment, said vertical cables are suspended from a beam or cable above the surface of the water, and the bottom ends of at least two vertical cable strings constituting the side edges of said wall are moored to elements anchored or placed on the water bottom, or they are merely tensioned by weights.

In a variant that can be appropriate, in particular, for certain uses that require the surface water to remain unencumbered, the bottom ends of said vertical cables can be moored to a bottom mooring cable or beam that is secured to elements that are anchored or placed on the water bottom, such as piles or sinkers, while the top ends of said vertical cables are tensioned by tensioning means such as stays or a top float.

When using a float, said blocks are preferably made of lightweight concrete or of plastics material or of composite material.

The present invention also provides a method of damping swell and chop characterized in that a device of the invention is immersed in a substantially vertical position.

More particularly, a said device is installed vertically under pontoons, preferably between the two piles supporting them, still more particularly under mooring and offloading pontoons in a port installation.

Preferably, the device of the invention is immersed in such a manner that:

- the top edge of said wall constituted by the top faces of the top end blocks of said vertical cable strings is flush with the surface level of the water or is at a height above, or a depth below, the water surface that is less than 1 meter (m); and
- the bottom edge of said wall constituted by the bottom faces of the blocks at the bottom ends of said vertical cable strings is situated at least 0.5 m from the bed. Thus, if the device is not moored at its bottom end, swinging movements do not interfere with the bed or any obstacles that already exist or that subsequently arise on the bottom.

In an advantageous embodiment, at least two rows of devices of the invention are installed in parallel.

Compared with the conventional massive solutions of the prior art, the device of the invention presents the following advantages:

- compact in terms of horizontal area;
- reduced installation cost;
- work can be performed in stages with quays on piles being put into place progressively as the use of a stretch of water changes;
- there is no amplification of water roughness due to reflection of waves having a period that is "long" (compared with the inertia of the curtain); and
- because of its flexibility, it can withstand extreme levels of swell.

BRIEF DESCRIPTION OF THE DRAWINGS

Other characteristics and advantages of the present invention appear in the light of the following detailed description with reference to the following figures, in which.

DETAILED DESCRIPTION OF THE PRESENTLY PREFERRED EMBODIMENTS

Figure 1:
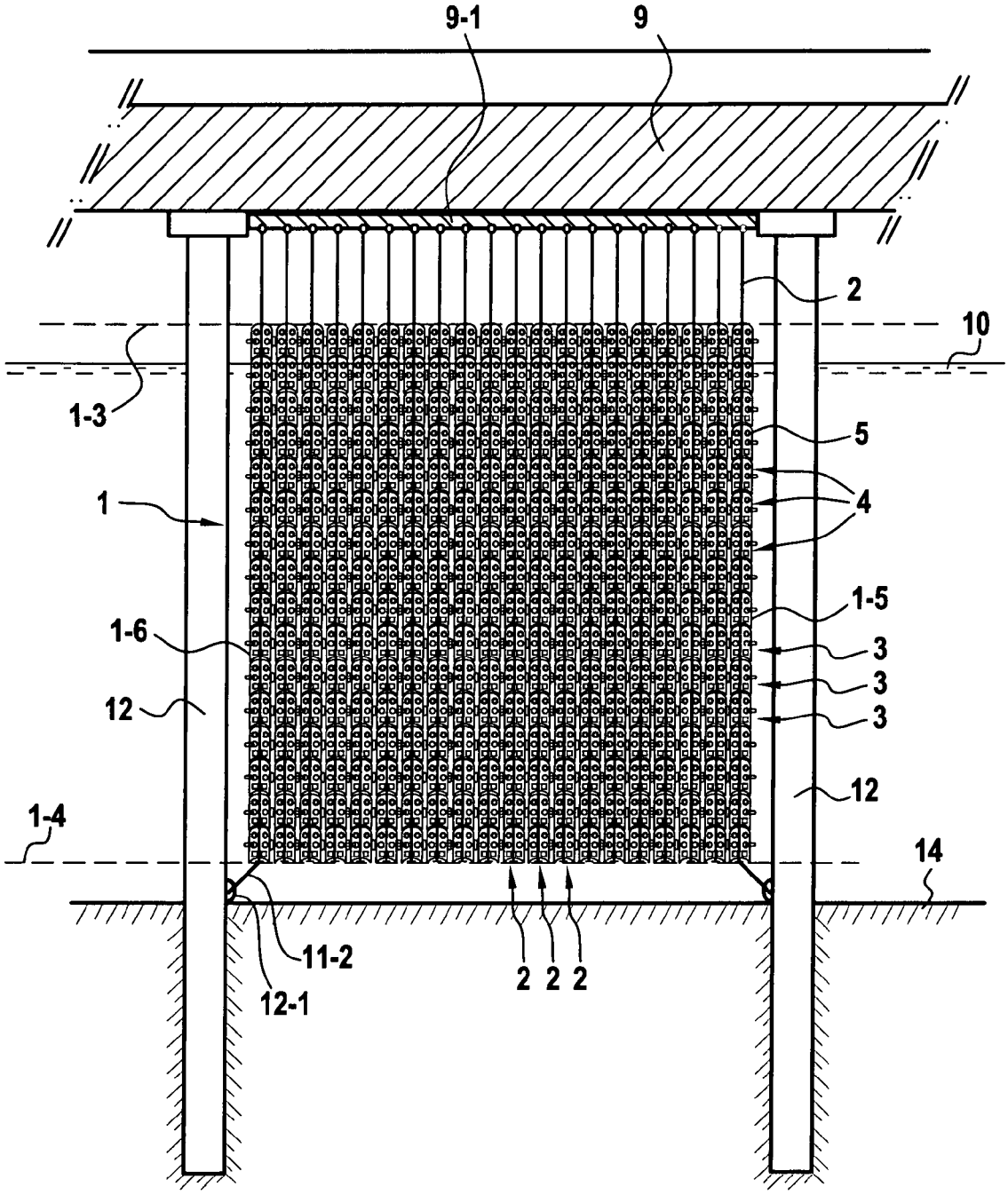
FIG. 1 is a face view of a damper device of the invention installed in suspension under a pontoon 9 between two piles 12 supporting the pontoon.

FIG. 1 shows a pontoon constituted by a deck 9 resting on piles 1-2 anchored in the sea bottom 1-4 and supporting of a device of the invention also referred to herein as a "porous curtain" of the invention, that is suspended by a multiplicity of vertical cables 2 from a beam 9-1 secured to said deck. Mooring cables 11-2 situated in the bottom portion of the curtain 1 are connected to attachment points 12-1 secured to said piles 12, thus holding the curtain in a configuration that is substantially plane in spite of the currents and the swell to which it is subjected.

Figure 2:
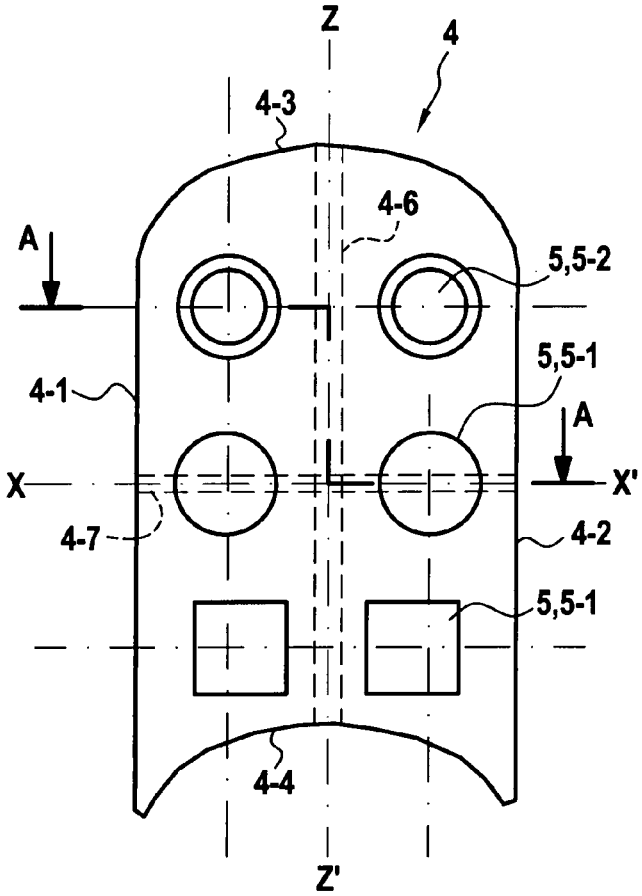
FIG. 2 is a face view of a unit block presenting self-locking shapes on its top and bottom faces and presenting cylindrical and frustoconical perforations passing therethrough.
Figure 3:
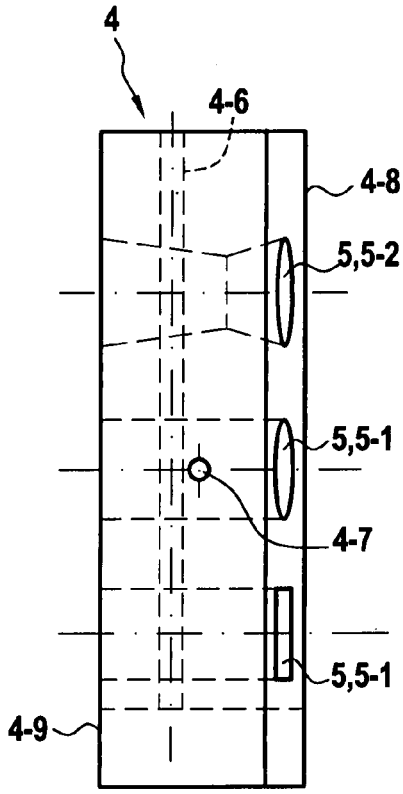
FIG. 3 is a side view of a side face 4-2 of a block as shown in FIG. 2.
Figure 6A:
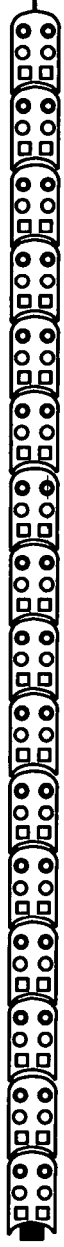
FIGS. 6A, 6B, and 6C are face views of assemblies of blocks presenting a variety of porosities so as to form vertical cable strings of uniform porosity (FIG. 6A), of porosity that decreases going downwards (FIG. 6B), or of porosity that is reduced in a central portion between top and bottom ends (FIG. 6C)
Figure 6B:
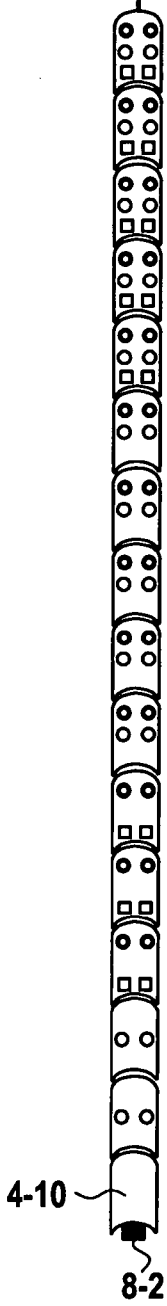
Figure 6C:
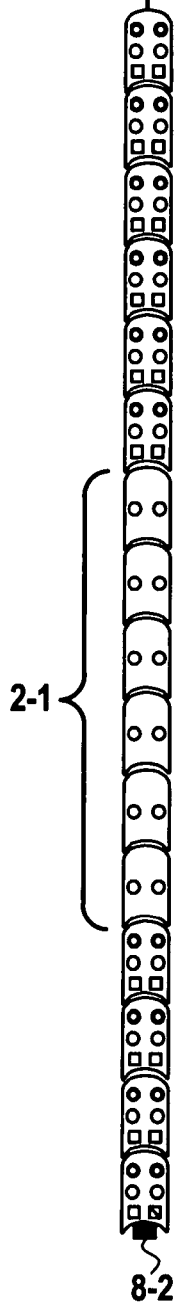

FIG. 2 is a face view of a unit block 4 used for making up the porous curtain. It is constituted by a massive body preferably obtained by casting a strong material, preferably a concrete, and it presents on two opposite faces, respectively a top end face 4-3 and a bottom end face 4-4, complementary curves, i.e. curves that are substantially identical and that enable the concave curve of the bottom face 4-4 of one block to be centered on the convex curvature of the corresponding top face 4-3 of the block beneath it. Each block has through holes, respectively downwards 4-6 as shown in section and in the plan view of FIG. 4, and horizontally from right to left 4-6 as shown in FIG. 3. These holes serve to pass cables, the vertical cable 2 of axis ZZ' serving to hold in suspension the blocks that are assembled together in mutually parallel vertical strings as shown in FIGS. 6A-6C. The blocks in a given vertical string rest directly one on another by gravity, a bottom washer 8-2 being crimped to the bottom portion of said vertical string in order to hold the assembly in place. The horizontal holes 4-7 of axis XX' enable a horizontal cable 3 to be passed through said blocks, thereby forming horizontal strings and enabling the vertical strings to be assembled to one another as to form the porous curtain 1.

Figure 4:
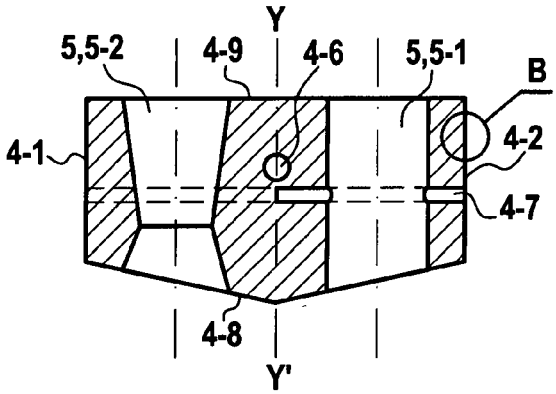
FIG. 4 is a section view from above on line AA of a block as shown in FIG. 2.

The blocks are also pierced across their thickness in the YY' direction by main orifices 5 in which head losses will occur, thereby attenuating the effects of the swell and of currents passing therethrough. These orifices 5 are empty holes open at both ends and connecting the front face 4-8 of the block to its rear face 4-9, as shown in FIGS. 2-3-4. They are cylindrical in shape 5-1 or frustoconical in shape 5-2, being circular or rectangular in section, or they are prismatic in shape 5-3, or of any intermediate shape. Their axes are preferably parallel to the axis YY', so as to facilitate prefabrication, mainly during unmolding, but they could also have a direction that is oblique in the XYZ frame of reference.

These orifices 5 confer porosity to the front and rear faces 1-1 and 1-2 of the wall or curtain 1, thereby having the effect of absorbing the kinetic energy of particles of water, either by friction against the walls, or by creating turbulence, and thus damping the speed of said particles of water, and hence reducing the speed of currents or the amplitude of swell or of chop passing therethrough.

Figure 4A:
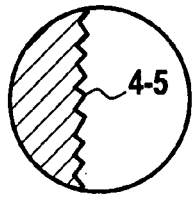
FIG. 4A shows a preferred sawtooth version 4-6 of the side wall 4-1, 4-2 of said block.

The front faces 4-8 of said blocks are advantageously shaped to improve the transfer of water flow towards the various head loss orifices 5, either with a pointed shape as shown in FIG. 4, or else with a convex curved shape (not shown). The side faces 4-1, 4-2 of the blocks advantageously present a sawtooth shape 4-5 for increasing the roughness of the passage 7 between two adjacent blocks, as shown in FIG. 4A.

Figure 5:
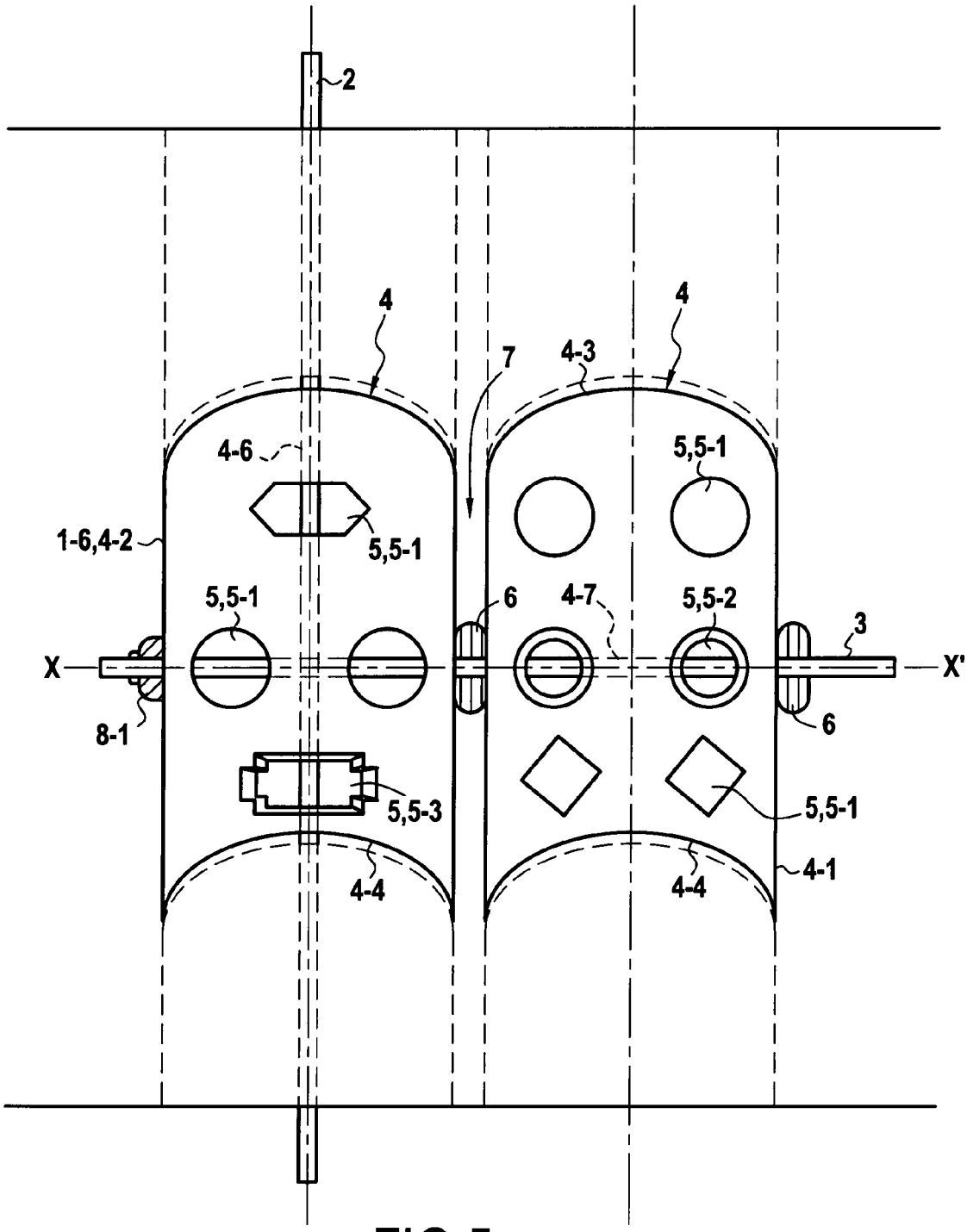
FIG. 5 is a face view showing an assembly of blocks in a sheet and presenting a variety of cylindrical, frustoconical, and prismatic variant perforations 5-1, 5-2, and 5-3.

FIG. 5 is a face view of an assembly of two vertical and horizontal strings showing two adjacent blocks. The suspension cable 2 passes vertically through the string of blocks, and the horizontal cable 3 passes horizontally along XX' through the assembly of adjacent blocks, each block being separated from the adjacent block by a pad 6 of controlled thickness, preferably made of elastomer, e.g. of neoprene, thereby giving the assembly a certain amount of flexibility. A bushing 8-1 is crimped on the cable at the extreme left 1-5 of the wall or curtain 1, and in the same manner a second bushing (not shown) is crimped onto its right end 1-6, after the cable has been tensioned, thus having the effect of compressing all of the elastomer pads to a uniform level of prestress. This gives a certain amount of stiffness to the curtain while maintaining a degree of flexibility, thereby giving it the ability to deform so as to damp swell and chop. In the figure, there can be seen orifices in a variety of shapes.

The empty spaces 7 between adjacent blocks on a given horizontal string, and between two vertical strings placed side by side also contributes to the overall porosity of the curtain 1, in a manner similar to the orifices 5, but to a lesser extent.

In FIGS. 6A-6B-6C there can be seen strings presenting different porosities. The string of FIG. 6A presents uniform porosity over its entire height. The string of FIG. 6B presents porosity that decreases going downwards, the bottom block 4-10 being opaque and made of very high density concrete, e.g. weighted with iron shot. The string of FIG. 6C presents a large amount of porosity at its top and bottom ends, while its intermediate portion 2-1 presents less porosity. Depending on the configuration of the site to be protected, damping is advantageously optimized by organizing porosity either nearer to the surface or further down. In order to limit phenomena associated with resonance of the curtain, in a configuration presenting porosity that is not uniform, it is advantageous to alternate several different types of vertical string, e.g. strings of the type shown in FIGS. 6A, 6B, and 6C, so that porosity also varies along a horizontal line.

Figure 9:
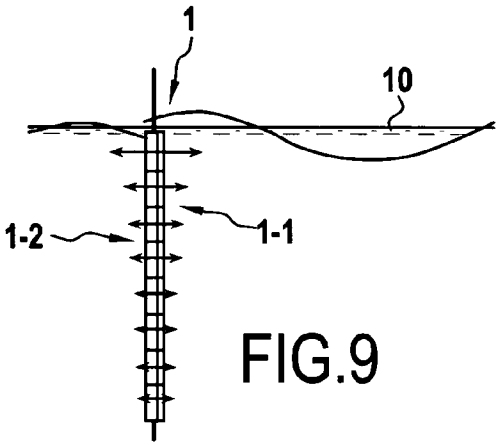
FIG. 9 is a side view showing how swell and chop are reduced when water passes through the device from its front face 1-1 towards its rear face 1-2.
Figure 7:
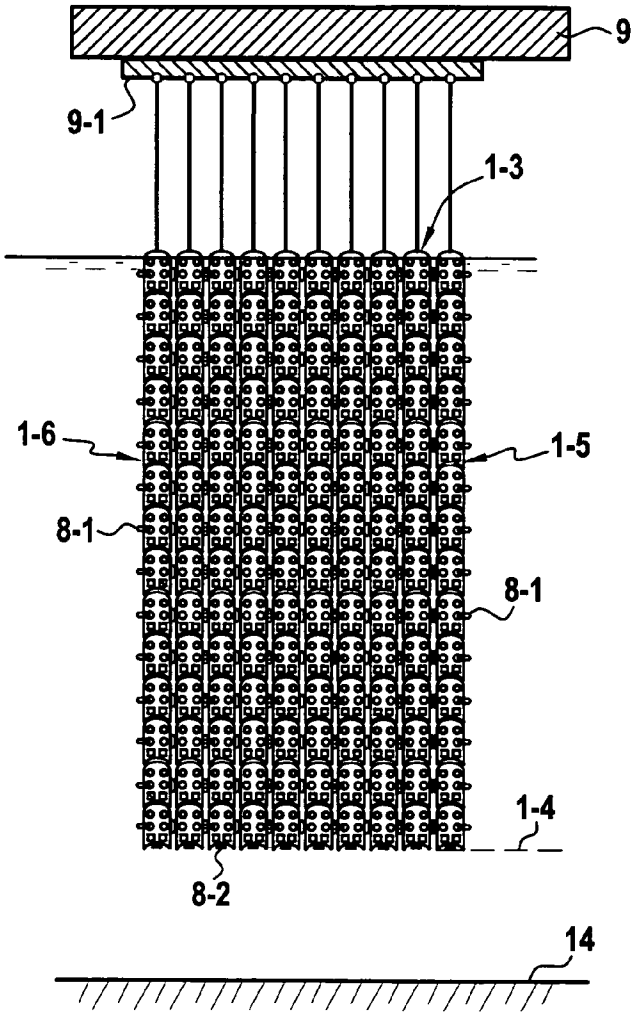
FIG. 7 is a face view showing a variant of FIG. 1, in which the device is completely immersed and flush with the surface.

In a preferred version shown in FIGS. 7 and 9, more particularly for use in zones of small tidal amplitude, the curtain is flush with the water level, such that swell can cross said curtain, but the flow of water passing through the curtain establishes a phase shift in the waves, thereby having the effect of attenuating said waves, and as a result the residual swell is strongly attenuated.

Figure 8:
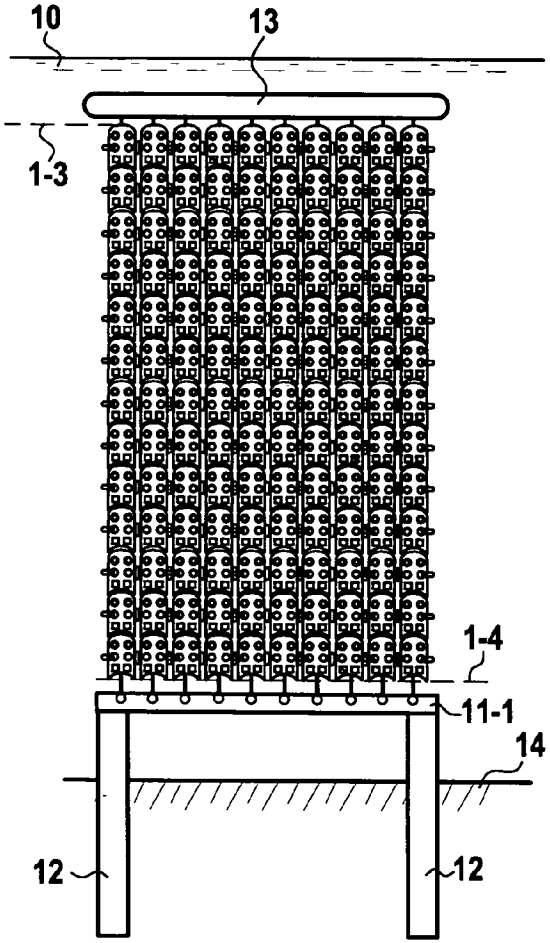
FIG. 8 is a face view of a variant in which the device of the invention is anchored to the sea bottom and is tensioned by a float (13)

In a variant of the invention shown in FIG. 8, the curtain is fastened to a bottom beam 11-1 secured to anchor points such as the piles 12, or indeed to sinkers merely placed on the bottom. A float 13 situated at the top of the curtain serves to tension it upwards and to maintain it in a position that is substantially vertical. Additional stays (not shown) preferably situated in the YZ plane advantageously improves the vertical stability of said curtain. The curtain is then immersed in such a manner that its top edge 1-3 comes to within 0.5 m to 1 m of the surface and does not obstruct the surface, which can be appropriate in certain utilizations, in particular for protecting a bathing zone or a zone in which boats of shallow draft are authorized.

When the curtains are suspended, the unit blocks 4 are preferably made by casting heavy materials, and when the curtains are tensioned by a float, as shown in FIG. 8 they are preferably made by casting lightweight materials. Amongst the heavy materials that can be used, it is advantageous to use concrete, which can advantageously be made heavier when producing the bottom elements as shown in FIG. 6B. Amongst lightweight materials, use can advantageously be made of concrete including lightweight aggregates, or indeed structural combinations of concrete and of plastics materials.

The vertical support cable 2 and the horizontal tensioning cables 3 of the curtains 1 are advantageously of stainless steel or of plastics material, such as polyethylene, polyamide, or polyimide, or any other strong fiber that is insensitive to water.

The dimensions of the block 4 depend on the means available for prefabrication and on the available hoist means, being 0.4 m to 1.2 m in width, 0.6 m to 2 m in height, and 10 centimeters (cm) to 30 cm in thickness. The cylindrical or conical orifices, depending on the cross-section variants, have equivalent diameters (mean cross-sections) of 8 cm to 25 cm, depending on the type of damping that is desired. To avoid chipping during handling and also during their lifetime, the edges of the blocks are advantageously rounded, thereby making them easier to unmold, particularly when concrete is used for making them.

Adjacent blocks on a horizontal cable 3 should be at a spacing 7 of 0.015 m to 0.2 m.

As an illustration, the curtain of FIGS. 7 and 8 presents overall porosity of 28.5%, each block pierced by orifices 5 presenting porosity of 23.8%, with said orifices 5 together representing 71% of the overall porosity and the remainder of the porosity being provided by the empty spaces 7 between adjacent blocks, the sections of the elastomer pads 6 being opaque, as is the mass of the blocks.

As a general rule, in order to perform their function of damping propeller slipstreams, the curtains need to extend across an entire cross-section of water, however it is preferred to leave the bottom edge 1-4 of the curtain at about 0.5 m or even 1 m from the sea bed, so that swinging movements of a device that is not moored at the bottom do not interfere with said bed or any obstacle that already exists thereon or that arrives subsequently.

The overall dimensions of the curtain 1 are advantageously selected so as to comply with highway loading gauges, i.e. said curtains should not exceed 2.5 m in width, with devices that are not shown in the figures enabling two adjacent devices to be assembled together in rigid or hinged manner so that they deform together under the effect of propeller slipstreams, chop, or low levels of swell.

The device of the invention is intended mainly for damping the currents induced by propeller slipstreams and by chop and wash from ships, but it can also be applied without limitation to medium or long swell. The separation period between waves that are stopped and that are transmitted is not in any way absolute technically speaking. It is always possible to increase the mass, the stiffness, the anchoring, the porosity, etc. . . . so that the device of the invention can be made to oppose swell of arbitrary period.

The device of the invention is simultaneously:

flexible to limit internal forces under the effect of these stresses, and also to avoid interacting excessively with long-period swell; and of high inertial mass, and preferably heavy when out of water, so as to present a large amount of inertia against the intended hydrodynamic stresses.

In principle, its top is merely suspended from a fixed structure or a structure presenting a large amount of inertia relative to waves (e.g. a floating platform), however it is advantageous also to anchor it at it bottom end or at any other point.

In a preferred version of the invention, at least two or even three or more rows of devices of the invention are advantageously installed in parallel, said devices being spaced apart more particularly from one another by a few meters. Under such circumstances, each of the rows advantageously presents its own porosity and stiffness, for example a first row of medium porosity that is simply suspended while being tensioned by a series of massive bottom blocks of the 4-10 type, and a second row of low porosity distributed uniformly over its height, each of the devices being anchored at the bottom and strongly tensioned in order to remain substantially plane, as shown in FIG. 1.

The invention claimed is:

1. A water movement device comprising a flexible wall placed in water close to a surface of water, substantially vertically in a static rest state, made up of optionally perforated massive unit blocks assembled to one another in strings by cables on which said blocks are threaded or on which said blocks are crimped, said cables comprising:

a first series of cables disposed vertically and side by side, parallel to one another; and a second series of cables disposed horizontally one above another and in parallel; and each block is pierced through in the vertical direction and in the horizontal direction, so as to enable at least one said vertical cable and at least one said horizontal cable to pass therethrough, and each said block is assembled to at least one vertical cable, thereby forming a plurality of parallel vertical cable strings, and at least some of said blocks, thereby assembling the various vertical cable strings to one another, and said vertical cables being suspended or tensioned at their top ends and/or respectively tensioned or moored at their bottom ends; and said blocks are assembled in strings with each block having a top face and a bottom face, wherein the top faces of lower blocks come against the bottom faces of higher blocks along said vertical cables; and said blocks are spaced apart from one another along said horizontal cables by pads and said blocks comprising:

empty orifices passing through said blocks between the front and rear faces of said wall; and/or empty spaces between said blocks;

whereby said orifices and/or empty spaces between said blocks confer overall porosity to said wall preferably representing 5% to 75% of the area of the vertical section of said wall.

2. The device according to claim 1, wherein said blocks have top and bottom faces of complementary shapes so as to provide self locking between said top and bottom faces respectively of two adjacent blocks along a said vertical cable.

3. The device according to claim 1 wherein the vertical cables are suspended and tensioned by the weight of the set of said blocks resting on one another by gravity, with the bottom end block being secured to the cable so as to retain all of said blocks on a given vertical cable.

4. The device according to claim 1, wherein at least a portion of said blocks present said orifices.

5. The device according to claim 4, wherein each block includes at least one said orifice.

6. The device according to claim 4, wherein each block has a plurality of said orifices.

7. The device according to claim 6, wherein said blocks present said orifices of different shapes.

8. The device according to claim 4, wherein said orifices present porosity representing at least 50% of said porosity of said wall.

9. The device according to claim 4, wherein said orifices present a cylindrical or frustoconical shape, preferably of circular section, or a shape of prismatic type with square or rectangular section.

10. The device according to claim 4, wherein said orifices present axes in the direction that is perpendicular to said front and rear faces of said wall.

11. The device according to claim 4, wherein said perforated blocks present identical porosities.

12. The device according to claim 4, wherein said blocks in a given vertical cable string present porosity that decreases going downwards.

13. The device according to claim 12, wherein the bottom end block is a non-perforated block made of concrete that is heavier than that of the other blocks.

14. The device according to claim 12, wherein said wall is constituted by assembling together said strings of vertical cables that present different porosities so that along a said horizontal cable string variations in the porosities of the blocks are observed between different portions of said horizontal string.

15. The device according to claim 4, wherein said blocks in a given string of vertical cables present greater porosity in the high and low portions than in an intermediate portion.

16. The device according to claim 1, wherein said vertical cables are suspended from a supporting beam or cable above the surface of the water, and the bottom ends of at least two strings of vertical cables constituting the side edges of said wall are moored to elements anchored or placed on the water bottom, or are tensioned merely by means of weight.

17. The device according to claim 1, wherein the bottom ends of said vertical cables are moored to a bottom mooring beam or cable secured to elements anchored or placed on the sea bottom such as piles or sinkers, and the top ends of said vertical cables are tensioned by tensioning means such as stays or a top float.

18. The device according to claim 17, wherein said blocks are made of lightened concrete, of plastics material, or of composite material.

19. The device according to claim 1, wherein:

said blocks present the following dimensions:

0.4 m to 1.2 m in width;

0.6 m to 2 min height;

0.10 m to 0.30 in thickness; and said orifices present a diameter or mean cross-section dimension of 0.08 m to 0.25 m.

20. The device according to claim 1, wherein said overall porosity of said wall represents 20% to 45% of the area of the vertical section of said wall.

21. A method of damping water movements such as currents induced by propeller slipstreams, chop, and swell, the method comprising the step of immersing a water movement device in a substantially vertical position, the water movement device comprising a flexible wall placed in water close to a surface the water, substantially vertically in a static rest state, the device made up of optionally perforated massive unit blocks assembled to one another in strings by cables on which said blocks are threaded or on which said blocks are crimped, said cables comprising a first series of cables disposed vertically and side by side, parallel to one another; and a second series of cables disposed horizontally one above another and in parallel; and each block being pierced through in the vertical direction and in the horizontal direction so as to enable at least one said vertical cable and at least one said horizontal cable to pass plurality of parallel vertical cable strings, and at least some of said blocks, thereby assembling the various vertical cable strings to one another, said vertical cables being suspended or tensioned at their top ends and/or respectively tensioned or moored at their bottom ends; and said blocks are assembled in strings with each block having a top face and a bottom face, wherein the top faces of lower blocks come against the bottom faces of higher blocks along said vertical cables; and said blocks are spaced apart from one another along said horizontal cables by pads, said blocks comprising:

empty orifices passing through said blocks between the front and rear faces of said wall; and/or empty spaces between said blocks;

whereby said orifices and/or empty spaces between said blocks confer overall porosity to said wall preferably representing 5% to 75% of the area of the vertical section of said wall.

22. The method according to claim 21, wherein a said device is installed in a port zone, substantially vertically beneath pontoons between two piles supporting the pontoons.

23. The method according to claim 21, wherein the step of immersing the device is performed in such a manner that:

the top edge of said wall constituted by the top faces of the top end blocks of said vertical cable strings is flush with the surface level of the water or at a height above or a depth below the water surface of less than 1 m; and the bottom edge of said wall constituted by the bottom faces of the blocks at the bottom ends of said vertical cable strings is situated at least 0.5 m from the bed.

24. The method according to claim 21, wherein at least two rows of the device of the invention are installed in parallel.

* * * * *